US006261166B1

(12) United States Patent
Asakawa et al.

(10) Patent No.: US 6,261,166 B1
(45) Date of Patent: Jul. 17, 2001

(54) WIRE CLEANING APPARATUS

(75) Inventors: Keiichiro Asakawa; Hiroshi Oishi; Junichi Matsuzaki, all of Annaka; Shinnji Shibaoka; Shigeru Okubo, both of Mitaka, all of (JP)

(73) Assignee: Super Silicon Crystal Research Institute Corp. (JP)

( * ) Notice: Subject to any disclaimer, the term of this patent is extended or adjusted under 35 U.S.C. 154(b) by 0 days.

(21) Appl. No.: 09/481,315

(22) Filed: Jan. 11, 2000

(30) Foreign Application Priority Data

Jan. 12, 1999 (JP) ..... 11-005246

(51) Int. Cl.[7] ..... B28D 1/08

(52) U.S. Cl. ..... 451/444; 125/16.01; 125/16.02; 15/134

(58) Field of Search ..... 451/444; 125/16.01, 125/16.02, 21; 15/134.88, 256.6

(56) References Cited

U.S. PATENT DOCUMENTS 4,578,120 * 3/1986 Chiarella ..... 15/256.6 X
5,201,305 * 4/1993 Takeuchi ..... 125/16.02 X
5,628,301 * 5/1997 Katamachi ..... 125/16.02 X

* cited by examiner

*Primary Examiner*—Joseph J. Hail, III
*Assistant Examiner*—Anthony Ojini
(74) *Attorney, Agent, or Firm*—Webb Ziesenheim Logsdon Orkin & Hanson, P.C.

(57) ABSTRACT

A newly proposed wire cleaning apparatus used for removing slurry from a wire, which reciprocatively travels between a slicing chamber and a wiring chamber. The wire cleaning apparatus has a couple of multigrooved guide rollers 41, 42 rotatably provided at a cover 30. A slurry receiver 20 is detachably attached to the cover 30. A centrifugal force is generated during repeated reciprocative movement of the wire 5 between the multigrooved guide rollers 41 and 42. Slurry is shaken off from the wire 5 by the centrifugal force and gathered in the slurry receiver 20. Removal of the slurry is accelerated by spraying a cleaning liquid W at the same time. Introduction of the cleaning liquid W into the slicing chamber is inhibited by on-off control of the cleaning nozzles 41, 42 in response to a travelling direction of the wire 5.

2 Claims, 4 Drawing Sheets

45a
46a
45
46
30
5
42
20
41
45(46)
41a(41b)
33
34
32
41(42)
23
21
31
22
35
30
34
5
33
41
42
46
45
20

WIRE CLEANING APPARATUS

BACKGROUND OF THE INVENTION

1. Field of the Invention

The present invention relates to an apparatus for cleaning a wire of a wire saw useful for slicing ingots or the like to thin wafers.

2. Brief Description of the Prior Art

After top and tail parts are cut off an ingot produced by a pulling method or the like, the ingot is ground at its periphery, subjected to orientation flat processing and then sliced to wafers of predetermined thickness. Although an inner blade slicer has been used so far for slicing the ingot, it does not well cope with a tendency of enlargement of wafers in diameter. Therefore, a wire saw machine using a piano wire has been recently adopted in response to enlargement of wafers.

A conventional wire saw has three grooved rollers 1–3, one of which (the roller 3) is coupled to a drive motor 4, as shown in FIG. 1. A wire 5 is pulled out from a reel 6, passed around the grooved rollers 1 to 3 multiple times and then wound on another reel 7. A tensioner 8 applies a tension to the wire 8. Thus, the wire 5 travels in a stretched state along a travel path around the grooved rollers 1 to 3.

An ingot 9 to be sliced is fixed to a holder 10 using a proper adhesion jig and located at a position between the grooved rollers 1 and 2. The ingot 9 is sliced to a plurality of wafers by cutting motion of the wire 5. During slicing, slurry 11 is supplied from a slurry tank 11 through a supply tube 13 to a nozzle 14, sprayed onto the wire 5, collected in a pan 15 and then returned to the slurry tank 12, in order to promote the cutting motion. The slurry 11 is cooled by circulation between the slurry tank 12 and a heat exchanger 16.

The slurry 11 still adheres onto the wire 5 due to its stickiness, even when the wire 5 after being used for slicing the ingot 9 travels toward the reel 6 or 7. If the wire 5 together with the slurry 11 is wound as such on the reel 6 or 7, the slurry 11 scatters in the circumference during winding and causes contamination of a wiring chamber wherein the reels 6, 7 are located.

There are various members and tools except the reels 6, 7 in the wiring chamber. For instance, a dancer roller 17 and a traverser 18 for adjusting a winding number of the wire 5 on the reels 6, 7 and for controlling a tension applied to the wire 5. Scattering and accumulation of the slurry 11 in such wiring chamber likely induces occurrence of mechanical troubles. In this sense, the wiring chamber shall be kept in a dean state free from scattering and accumulation of the slurry 11. Unfavorable introduction of the slurry of 11 into the wiring chamber also accelerates abrasion of various rollers located in the wiring chamber.

The slurry 11 can be washed off from the wire 5 by a washer provided at a travelling path of the wire 5 between the slicing chamber and the wiring chamber so as to spray a cleaning liquid to the wire 5. However, such a washer shall have enough length along the travel path of the wire 5, in order to sufficiently wash off the slurry 11 by spraying the cleaning liquid to the running wire 5. As a result, a huge washer is necessitated. In addition, removal of the slurry 11 is insufficient only by spraying the cleaning liquid, so that some residual slurry is involved together with the wire 5 in the reels 6, 7.

SUMMARY OF THE INVENTION

The present invention aims at provision of a new wire cleaning apparatus without the above-mentioned problems.

The newly proposed wire cleaning apparatus uses a centrifugal force for shaking off slurry from the wire. The centrifugal force is generated by repeated reciprocative movement of the wire between multigrooved guide rollers located at a travel path of the wire. Removal of the slurry is well performed due to the effect of the centrifugal force on separation of the slurry from the wire.

The newly proposed wire cleaning apparatus has a couple of multigrooved guide rollers on which the wire is wound several times, a cover to which the multigrooved guide rollers are rotatably attached, and a slurry receiver detachably attached to the cover. A centrifugal force is generated during repeated reciprocative movement of the wire between the multigrooved guide rollers.

Although the slurry is shaken off from the wire by the centrifugal force, removal of the slurry is accelerated by spraying a cleaning liquid at the same time. In order to spray a cleaning liquid, a nozzle or nozzles directed to surfaces of the multigrooved guide rollers are provided at the cover. In such a case, the nozzle or nozzles are preferably on-off controlled in response to a travelling direction of the wire, so as to inhibit introduction of the sprayed cleaning liquid into the slicing chamber.

DETAILED DESCRIPTION OF THE PREFERRED EMBODIMENTS

Figure 1:
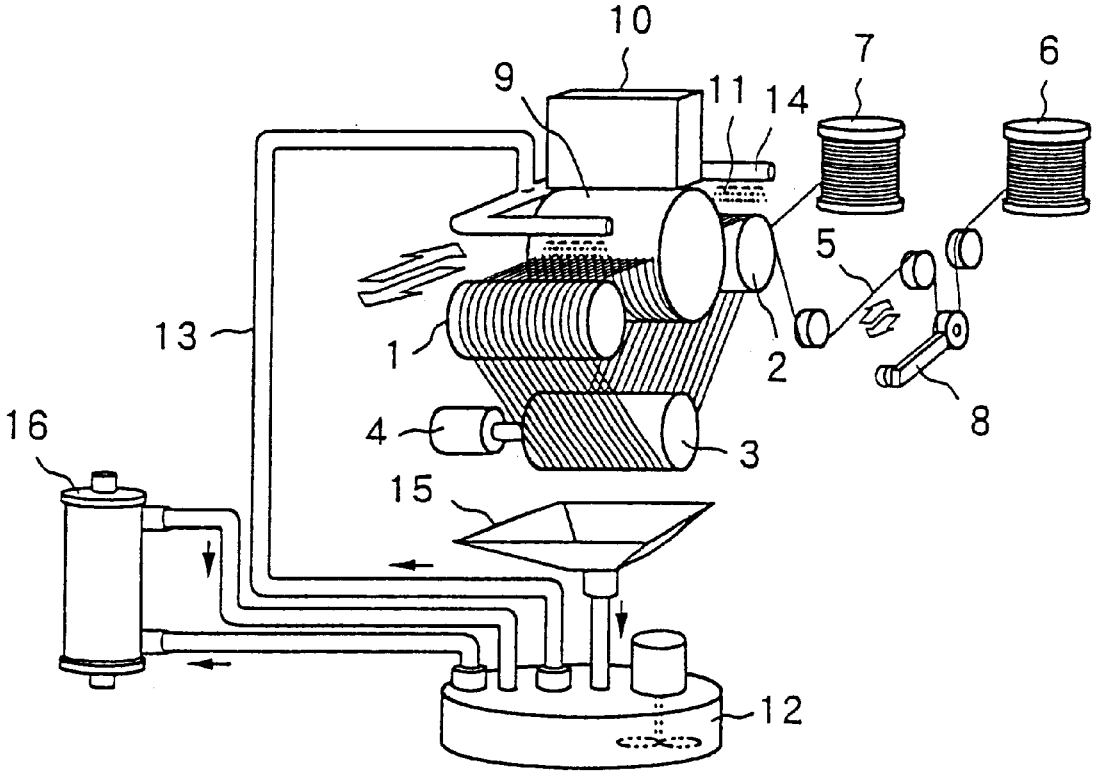
FIG.1 PRIOR ART
FIG. 1 is a schematic view illustrating a wire-sawing machine.
Figure 2:
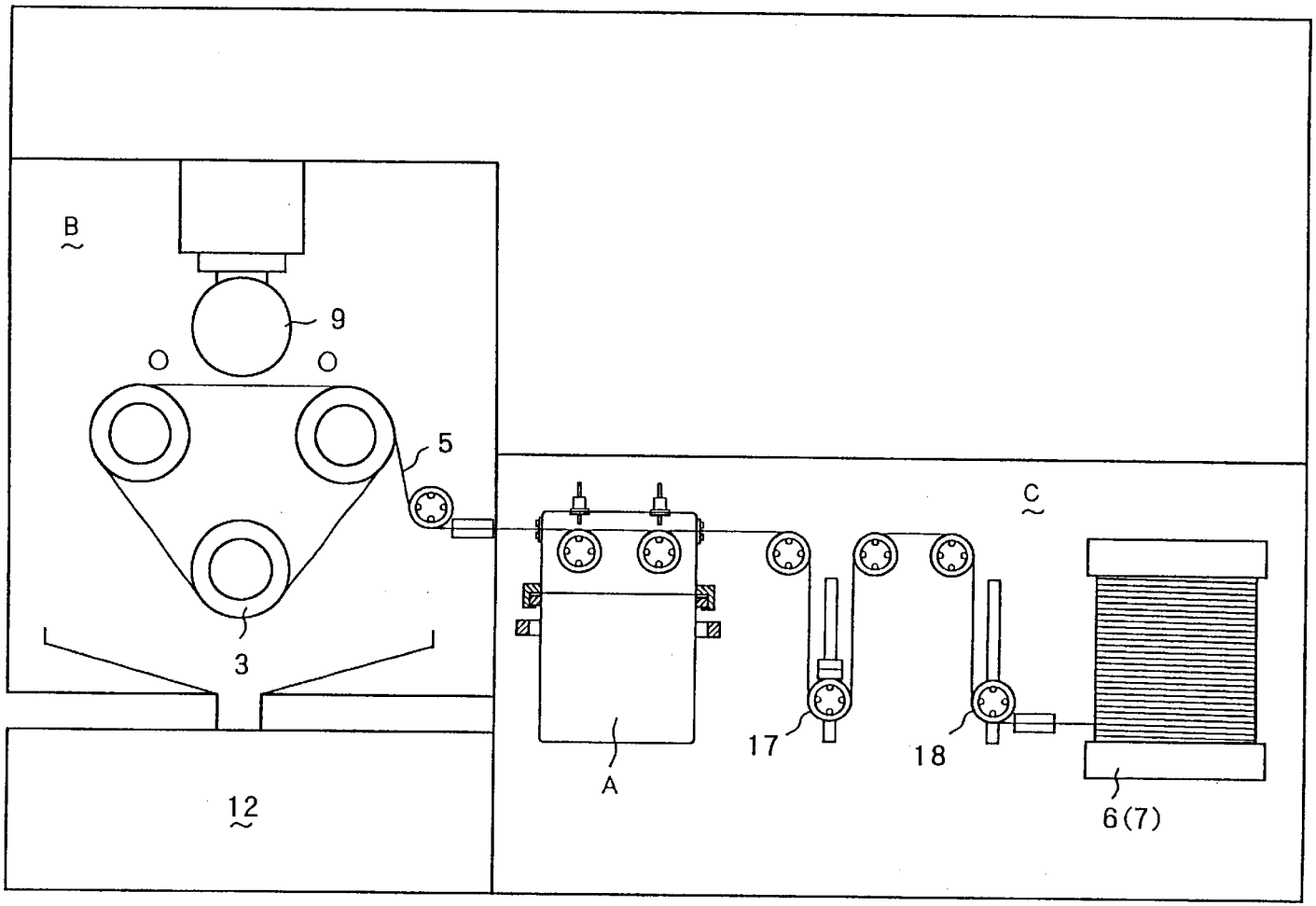
FIG. 2 is a view showing location of a wire cleaning apparatus in a travel path of a wire between a slicing chamber; and a wiring chamber.

According to the present invention, two wire cleaning apparatuses A are located at two positions near entrances of wiring chambers C, which are provided adjacent to a slicing chamber B, corresponding to reels 6, 7, respectively, as shown in FIG. 2. One wire cleaning apparatus A may be also used for cleaning the wire 5 at both sides of the reels 6, 7. In such a case, a travelling path of the wire 5 toward the reel 6 is set close to the other travelling path of the wire 5 toward the reel 7. After the wire 5 is sent from the slicing chamber B to the cleaning apparatus A, the slurry 11 is washed off from a surface of the wire 5. Thereafter, the wire 5 is forwarded through a dancer roller 17 and a traverser 18 and then wound on the reel 6 or 7.

Figures 3A, 3B, 3C:
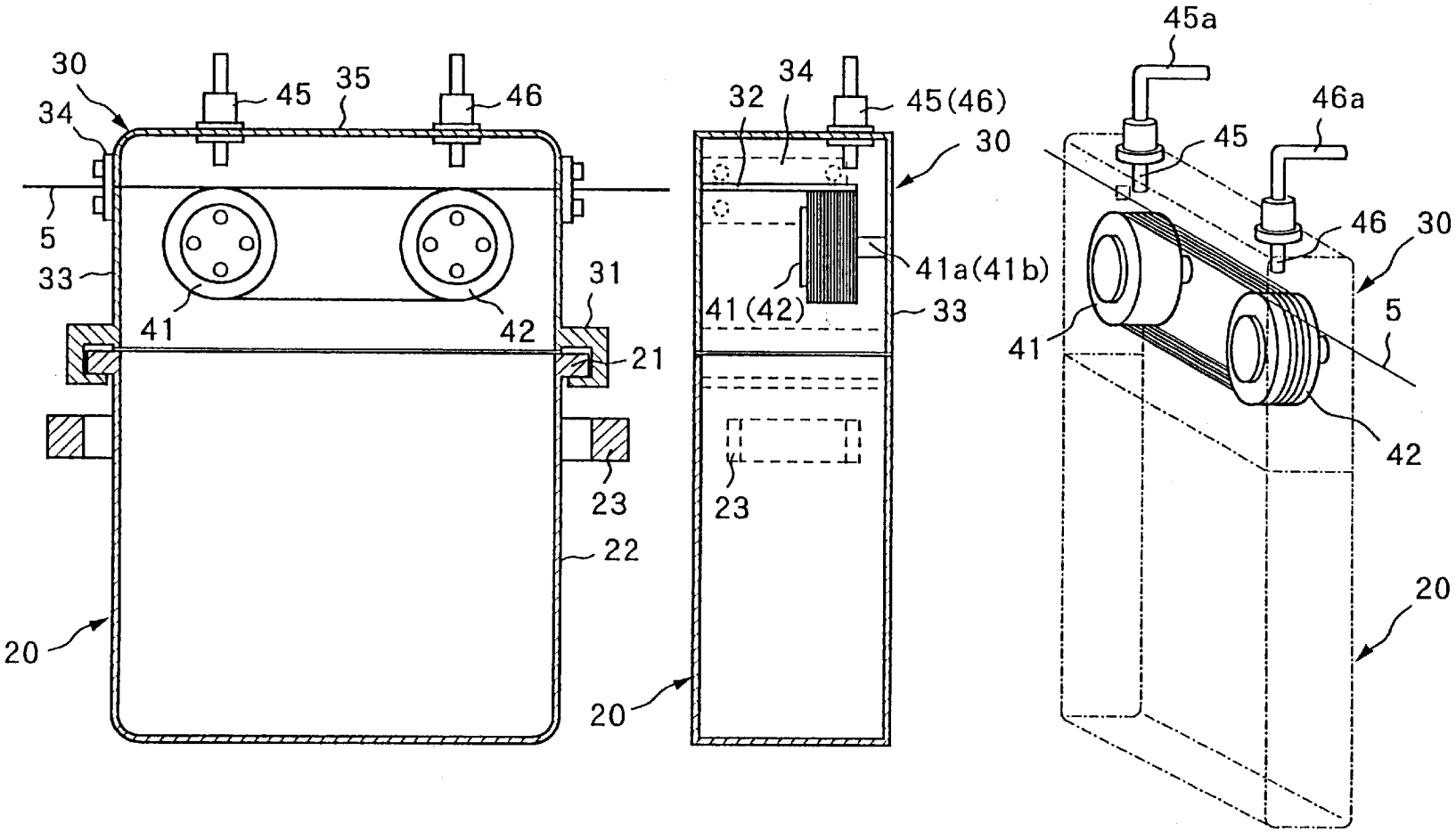
FIG. 3A is a view illustrating internal construction of the wire cleaning apparatus shown along a direction perpendicular to a travel path of the wire.
FIG. 3B is a view illustrating the same internal construction of the wire cleaning apparatus shown along a direction parallel to a travel path of the wire.
FIG. 3C is a bird's-eye view showing locations multigrooved guide rollers.

The wire cleaning apparatus A has a drawable slurry receiver 20 provided at a cover 30, as shown in FIGS. 3A–B. The slurry receiver 20 is a vessel having a side wall 22. A flange 21, which is inserted into a gap 31 of the cover 30, is formed at an upper part of the side wall 22. A handle 23 is provided at a position below the flange 21, so as to facilitate drawing motion of the slurry receiver 20. The slurry receiver 20 is drawn along a direction perpendicular to the sheet in FIG. 3A. Of course, the slurry receiver 20 may be attached to the cover 30 in other manners.

The cover 30 has a side wall 33. A slit 32 is formed in the side wall 33 along a widthwise direction. The wire 5, which reciprocatively travels between the slicing chamber B and the wiring chamber C, is sent through the slit 32 into the wire cleaning apparatus A. A protection metal fitting 34 made of a hard material excellent in abrasion-resistance is fixed to an edge of the slit 32, in order to inhibit abrasion of the side wall 33 by friction with the wire 5.

A couple of multigrooved guide rollers 41, 42 are located in the wire cleaning apparatus A Each multigrooved guide rollers 41, 42 has a rotating shaft 41*a*, 42*a* rotatably supported with the side wall 33 inside the wire cleaning apparatus A The multigrooved guide rollers 41, 42 can be reversed in response to both-way travel of the wires 5. Rotation of multigrooved guide rollers 41, 42 may be either of motor drive rotation or following rotation by friction with the wires 5.

A plurality of grooves (for instance 10 or so) are engraved on peripheries of the multigrooved guide rollers 41, 42. The wire 5 sent from the slicing chamber B reciprocatively travels between the multigrooved guide rollers 41 and 42 at times corresponding to the number of the grooves on the multigrooved guide rollers 41, 42, and then forwarded to the reel 6, 7 or the slicing chamber B. The number of the grooves on the guide rollers 41, 42 is properly determined according to the kind of slurry 11 to be used. For instance, a large number of grooves are engraved on the guide rollers 41, 42 in the case where slurry based on an oily coolant is used for slicing the ingot 9, since the oily coolant exhibits stronger adhesives than an aqueous coolant.

Cleaning nozzles 45, 46 are attached to an upper wall 35 of the cover 30 at positions facing the multigrooved guide rollers 41, 42, respectively. Each cleaning nozzle 45, 46 is led through a water supply tube 45*a*, 46*a* to a water source (not shown). Either one of the cleaning nozzles 45 or 46 may be omitted, since the sprayed cleaning liquid W is circulated between the multigrooved guide rollers 41 and 42.

Figure 4:
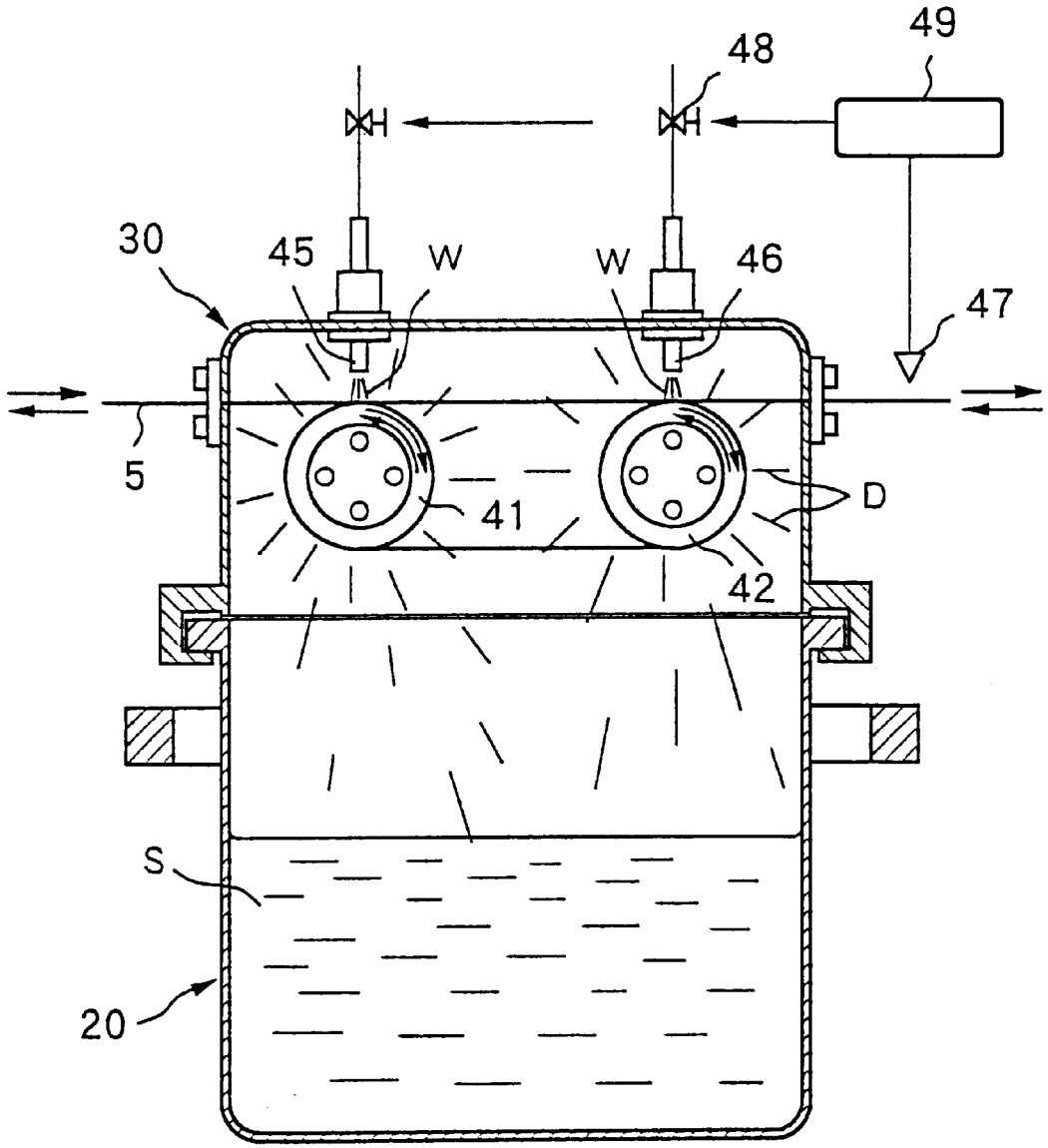
FIG. 4 is a view for explaining the phenomenon that slurry is shaken off from the wire.

A cleaning liquid W is sprayed from the cleaning nozzles 45, 46 to the wire 5 travelling around the multigrooved guide rollers 41, 42, as shown in FIG. 4. The travel paths of the wire 5 at the position where the cleaning liquid W is sprayed are curved along the peripheries of the multigrooved guide rollers 41, 42. Due to such curved travel paths, a centrifugal force is generated during repeated reciprocative movement of the wire 5 between the multigrooved guide rollers 41, 42 and applied to the wire 5. The centrifugal force together with an injection pressure of the cleaning liquid W promotes scattering of the slurry 11 as splashes D from the wire 5. The slurry splashes D bump against an inner surface of the cover 40 and flow downwards. The used slurry S is collected in the slurry receiver 20 in this way. When a predetermined amount of the slurry S is accumulated in the slurry receiver 20, the slurry receiver 20 is periodically drawn out for sending the recovered slurry S to post-treatment such as disposal or reprocessing. The recovered slurry S may be continuously discharged from the slurry receiver 20 outside the cleaning apparatus A through a conduit connected to a slurry tank (not shown), as occasion demands.

The cleaning nozzles 45, 46 are preferably on-off controlled with synchronization with a travelling direction of the wire 5. Concretely, the cleaning nozzles 45, 46 are opened to spray the cleaning liquid W to the wire 5, when the wire 5 travels from the slicing chamber B to the wiring chamber C. When the wire 5 travels from the wiring chamber C to the slicing chamber B on the contrary, spray of the cleaning liquid W is stopped by shutting the cleaning nozzles 45, 46. The on-off control suppresses inflow of the cleaning liquid W into the slicing chamber B and inhibits contamination of the slurry 11 with the cleaning liquid W during slicing of the ingot 9.

The on-off control of the cleaning nozzles 45, 46 is performed by a control system 49, whereby a traveling direction of the wire 5 is detected by a sensor 47 so as to output a command signal for shutting a check valve 48 when the travelling direction is from the wiring chamber C to the slicing chamber B or another command signal for releasing the check valve 48 when the travelling direction is from the slicing chamber B to the wiring chamber C. The on-off control may be performed in a different way, wherein a rotating direction of the reels 6, 7 or the multigrooved guide rollers 41, 42 is detected and the detection result is converted to a command signal for opening or shutting the cleaning nozzles 45, 46.

A travelling speed of the wire 5 is ordinarily determined within a range of 8–13 ml/second under actual operational conditions of the wire-sawing machine. When such high-speed travelling wire 5 passes along the curved paths on the peripheries of the multigrooved guide rollers 41, 42 having great curvatures, a centrifugal force big enough to shake off the slurry 11 from the wire 5 is generated. Consequently, the slurry 11 is shaken off from the wire 5 only by the centrifugal force without spray of the cleaning liquid W. Of course, removal of the slurry 11 is accelerated by spraying only a slight amount of the cleaning liquid W. Omission or saving of the cleaning liquid W means that there is not big fluctuation in the properties of the slurry S gathered in slurry receiver 20, and reuse of the recovered slurry S is also expected.

The centrifugal force is bigger, as diameters of the multigrooved guide rollers 41, 42 are smaller. However, if the multigrooved guide rollers 41, 42 are too small in diameter, the wire 5 is apt to be plastically deformed due to bending moment which is generated when the wire 5 travels around the multigrooved guide rollers 41, 42. In this regard, the multigrooved guide rollers 41, 42 preferably have diameters of 70–90 mm for a wire of 0.18 mm in diameter for instance, taking into account actual operational conditions.

The multigrooved guide rollers 41, 42 shown in the drawings are arranged on a horizontal plane. But, the multigrooved guide rollers 41, 42 may be arranged on a vertical plane instead. Locations of the cleaning nozzles 45, 46 are changed in response to such an arrangement. For instance, the cleaning nozzles 45, 46 are attached to the side wall 33 of the cover 30 at positions corresponding to the multigrooved guide rollers 41, 42 or hung from the upper wall 35 so as to direct to peripheries of the multigrooved guide rollers 41, 42, respectively.

The slurry 11, which adheres to the wire 5, is sufficiently separated from the wire 5 during repeated reciprocative movement of the wire 5 between the multigrooved guide rollers 41 and 42. Since the slurry 11 does not adhere to the wire 5 sent out of the wire cleaning apparatus A, various tools and members arranged along the travel path of the wire 5 through the dancer roller 17 and the traverser 18 to the reel 6 or 7 are not contaminated with the slurry 11. Consequently, the travelling condition of the wire 5 is stabilized without mechanical troubles caused by adhesion of the slurry.

Removal of the slurry 11 from the wire 5 is finished during repeated reciprocative movement of the wire 5 between the multigrooved guide rollers 41 and 42. Due to such slurry removing action, a space necessary for removal of the slurry 11 is ensured enough by positioning the multigrooved guide rollers 41, 42 apart from each other in a distance of about 100~150 mm between their roll centers. Such small space enables installation of the wire cleaning apparatus A without necessity of either fundamental design change of the wire-sawing machine itself or a washing apparatus much elongated along the travel path of the wire 5. In addition, the slurry S removed from the wire 5 is gathered in the slurry receiver 20 without scattering outside the wire cleaning apparatus A, so that a working environment is kept clean.

According to the present invention as above-mentioned, removal of slurry from a wire is well performed by a centrifugal force which is generated during repeated reciprocative movement of the wire between a couple of multigrooved guide rollers. The slurry is effectively shaken off from the wire by the centrifugal force, so as to inhibit introduction of the slurry together with the wire to various members and tools such as a dancer roll, a traverser and reels. Consequently, various members and tools arranged in a wiring chamber are protected from mechanical troubles caused by transfer and adhesion of the slurry, and travelling condition of the wire is stabilized. A space for removal of the slurry is very small, since removal of the slurry is finished during repeated reciprocative movement of the wire between the multigrooved guide rollers. Such a small space allows design of the wire-sawing machine with a high freedom without necessity of fundamental design change of the wire-sawing machine itself. In addition, a working environment is kept clean, since the slurry shaken off from the wire does not scatter outside the wire cleaning apparatus.

What is claimed is:

1. A wire cleaning apparatus for removing a slurry from a wire reciprocatively travelling between a slicing chamber and a wire chamber comprising:

a couple of multigrooved guide rollers for repeated reciprocative movement of a wire therebetween, a cover for supporting said multigrooved guide rollers in a rotatable state, at least one cleaning nozzle which directs a cleaning medium to at least one of said multigrooved guide rollers, and a slurry receiver detachably attached to said cover, wherein a slurry is shaken from the wire by a centrifugal force which is generated during repeated reciprocative movement of the wire between said multigrooved guide rollers.

2. The wire cleaning apparatus as claimed in claim 1, wherein the cleaning nozzle is shut when the wire travels from the wiring chamber to the slicing chamber.

* * * * *